US007458141B2

(12) United States Patent
Goldburt et al.

(10) Patent No.: US 7,458,141 B2
(45) Date of Patent: Dec. 2, 2008

(54) METHODS AND DEVICES FOR INSTALLING A GARBAGE DISPOSER

(75) Inventors: Igor Goldburt, San Francisco, CA (US); Yuriy Malakhov, San Francisco, CA (US); Aleksandr Malakhov, San Francisco, CA (US)

(73) Assignee: Innovative Pioneer, Inc., San Francisco, CA (US)

( * ) Notice: Subject to any disclaimer, the term of this patent is extended or adjusted under 35 U.S.C. 154(b) by 398 days.

(21) Appl. No.: 11/174,431

(22) Filed: Jul. 1, 2005

(65) Prior Publication Data

US 2007/0000116 A1 Jan. 4, 2007

(51) Int. Cl.

| | |
|---|---|
| ***B23P 19/04*** | (2006.01) |
| ***B23P 11/00*** | (2006.01) |
| ***B25B 27/14*** | (2006.01) |
| ***B02C 23/36*** | (2006.01) |

(52) U.S. Cl. ..... 29/464; 29/225; 29/229; 29/256; 29/264; 29/271; 29/428; 29/434; 29/525.01; 241/46.013; 241/46.014

(58) Field of Classification Search ..... 29/225, 29/229, 235, 256, 258, 264, 266, 271, 428, 29/434, 525.01; 241/46.013, 46.014; 4/DIG. 4
See application file for complete search history.

(56) References Cited

U.S. PATENT DOCUMENTS

| | | | | |
|---|---|---|---|---|
| 2,846,154 | A * | 8/1958 | Wieczorek | 241/46.015 |
| 3,982,703 | A * | 9/1976 | Meyers | 241/46.015 |
| 4,411,054 | A * | 10/1983 | Zeilenga | 29/434 |
| 5,177,853 | A * | 1/1993 | Herook | 29/266 |
| 5,560,052 | A * | 10/1996 | Ferguson et al. | 4/650 |
| 7,185,408 | B1 * | 3/2007 | Keith | 29/229 |

* cited by examiner

*Primary Examiner*—David P. Bryant
*Assistant Examiner*—Alexander P Taousakis
(74) *Attorney, Agent, or Firm*—Jens E. Hoekendijk

(57) ABSTRACT

The installation kit is used to install a garbage disposer. The kit is used to apply a compressive force to the sink flange during installation of a plumbing element, such as a strainer assembly, and also to support the motor/chopping assembly. The kit facilitates fast and safe installation of the garbage disposer by a single installer.

14 Claims, 5 Drawing Sheets

METHODS AND DEVICES FOR INSTALLING A GARBAGE DISPOSER

BACKGROUND OF THE INVENTION

The present invention is directed to methods and devices for installing a garbage disposer.

Mounting a conventional garbage disposer to a sink can be a challenging task. The installer often lies on his back with his head under the sink and works in a relatively tight space.

One step in the installation procedure is positioning a sink flange in the sink and connecting the sink flange to a strainer assembly positioned beneath the sink. A problem which occurs when installing the sink flange and strainer assembly is that downward pressure must be applied to the sink flange during installation. If the installer does not have an assistant, the installer may have to reach into the sink with one hand to hold the sink flange in place while manipulating the strainer assembly beneath the sink with the other hand. This presents obvious problems and difficulties when installing the sink flange and strainer assembly.

Another problem which occurs when installing a garbage disposer occurs during installation of the disposer motor assembly. Installation of the motor assembly generally requires attaching a mounting ring of the garbage disposer to a mounting ring attached to the sink. The installer may hold the motor assembly with one hand while trying to secure the mounting rings together with the other hand. This part of the installation is somewhat dangerous since the installer may lift the motor assembly over his head with one hand while attempting to secure the mounting rings together with the other hand.

SUMMARY OF THE INVENTION

The present invention provides methods and devices for installing a garbage disposer which overcomes problems with conventional methods and devices for installing a garbage disposer.

The installation kit has a first part which contacts the sink flange and a second part which is positioned beneath the sink. The first and second parts are coupled together with a connecting rod extending through the sink drain. The first and second parts are moved relative to one another so that the first part applies a compressive force to the sink flange.

The second part may also be used to support a plumbing element which is attached to the sink flange. The plumbing element may be any conventional or suitable garbage disposer or plumbing element such as a strainer assembly. The second part may have an interlocking structure with the plumbing connection so that the orientation of the second part and the plumbing element may be maintained. The second part may, for example, have holes which receive threaded elements on the strainer assembly. The threaded elements may be used to spread apart upper and lower parts of the strainer assembly so that a snap-fit ring is moved into engagement with a groove on the sink flange.

The installation kit may also be used as a stand to support the motor assembly before the motor assembly is attached to the sink.

These and other features and aspects of the present invention will become apparent from the following description, drawings and claims.

DESCRIPTION OF THE PREFERRED EMBODIMENTS

Figure 1:
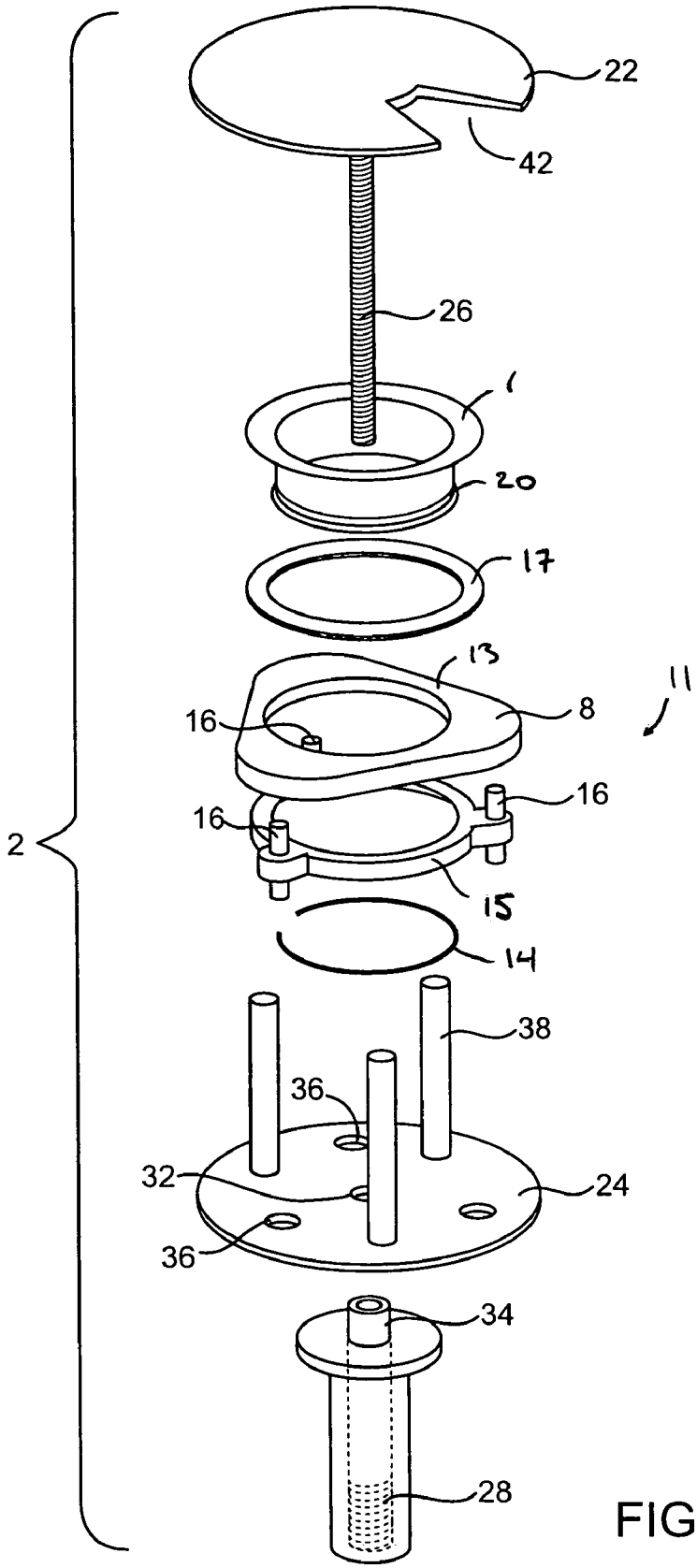
FIG. 1 shows an exploded view of an installation kit with a sink flange and plumbing elements such as a cardboard ring, a strainer assembly and a snap ring in accordance with the present invention.
Figure 2:
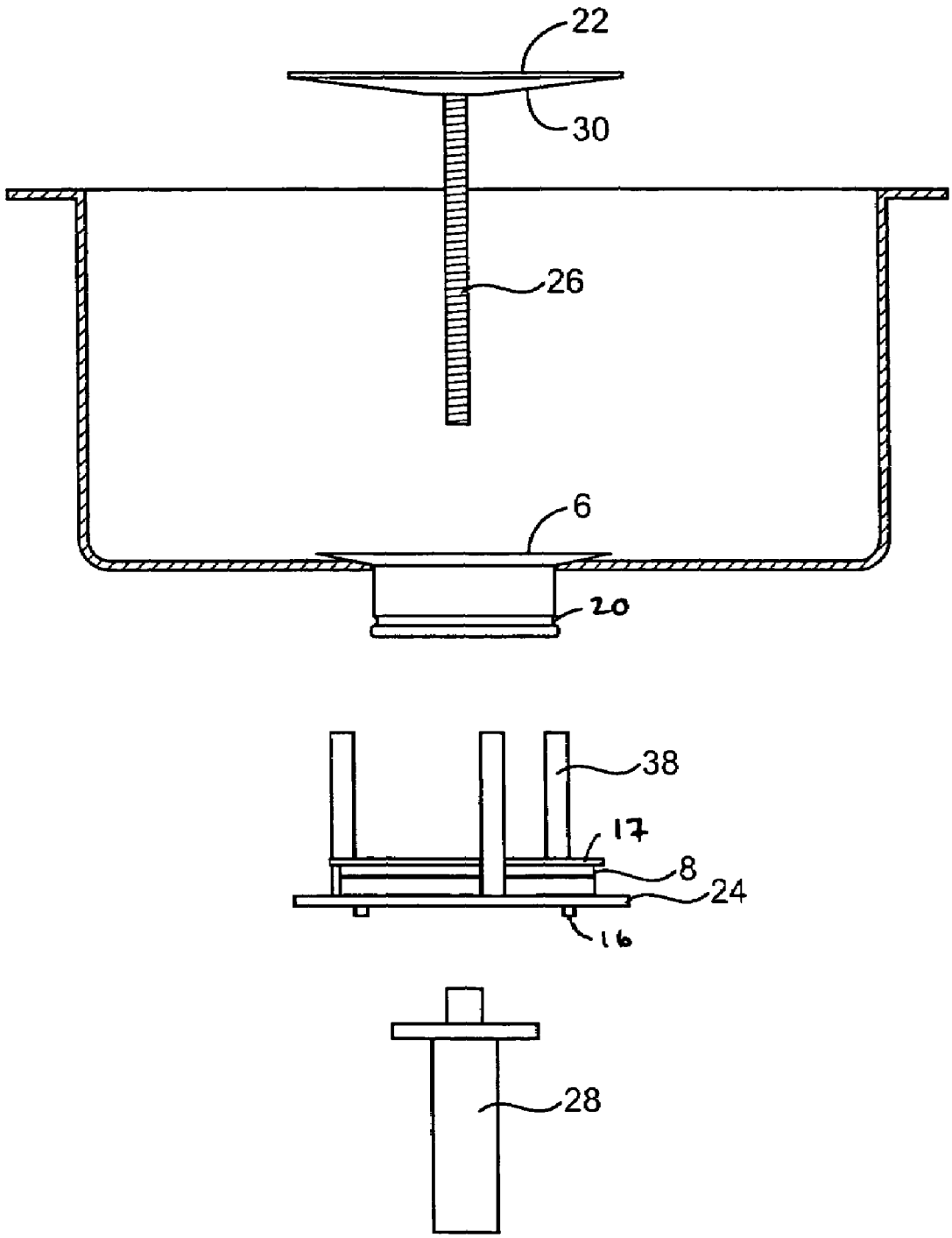
FIG. 2 is a cross-sectional view of a sink with the installation kit with a first part positioned above the sink and a second part positioned below the sink.
Figure 3:
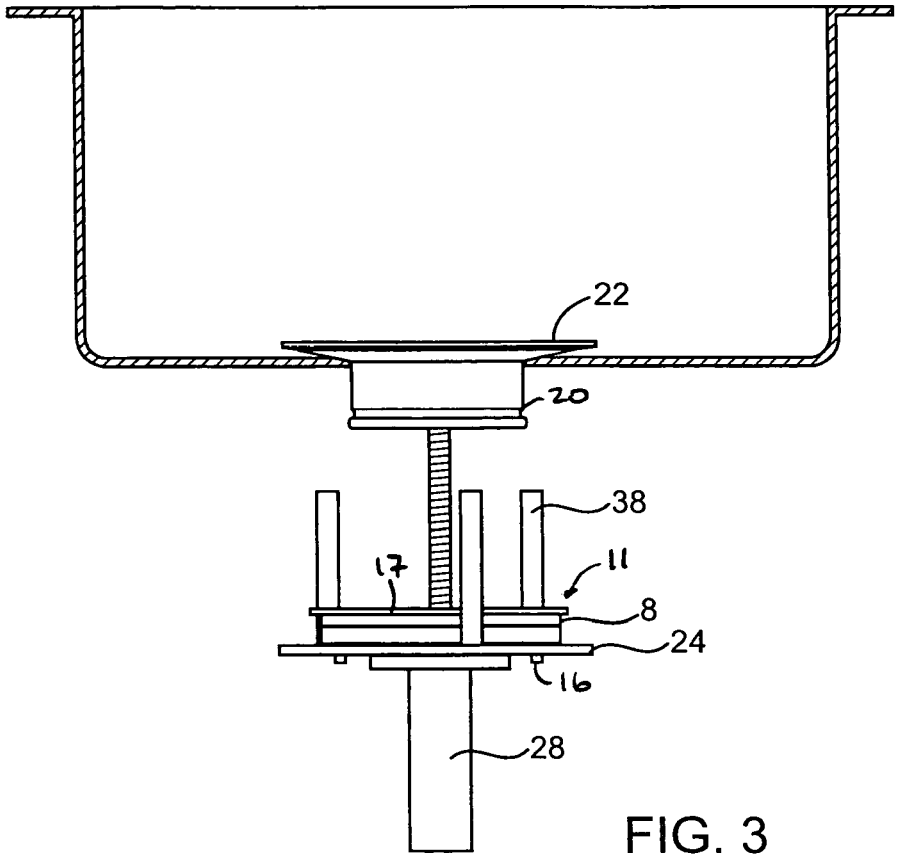
FIG. 3 shows the first part of the installation kit engaging the sink flange and the second part supporting a plumbing element.

Referring to FIGS. 1-7, an installation kit 2 for a garbage disposer 4 is shown. The present invention may be used to install any type of garbage disposer 4 and use with one type of garbage disposer 4 is described. Of course, the present invention may be used to install any other type of garbage disposer as can be appreciated from the following description.

Installation of the garbage disposer 4 may take different forms but generally requires a sink flange 6, which encircles and lines the drain opening, and a plumbing element 8 positioned beneath the sink and mounted to the sink flange 6. The plumbing element 8 may be any suitable part of the garbage disposer 4 or any suitable plumbing element such as a strainer assembly 11. The garbage disposer 4 also includes a motor assembly 9 which is attached to the plumbing element 8 or another suitable part of the sink or sink flange 6. The sink flange 6 may be provided with the garbage disposer 4, sold separately or provided with the sink.

The plumbing element 8 is attached to the sink with any suitable connector. For example, the plumbing element 8 may include a snap ring 14 which has a snap-fit engagement with a groove 20 on the sink flange 6. The plumbing element 8, which may be the strainer assembly 11, has an upper part 13 and a lower part 15. The upper part 13 and lower part 15 are spread apart using threaded elements 16 as is known in the art. When the upper and lower parts 13, 15 are spread apart, the upper part compresses a soft cardboard 17 disk against the underside of the sink and the lower part forces the snap ring 14 into engagement with the groove 20 on the sink flange 6. The motor assembly 9 may be coupled to the plumbing element 8 or any other part of the sink in any suitable manner. For example, the motor assembly 9 may have a mounting ring 18 that is coupled to the lower part 15 of the plumbing element 8 by a simple rotational engagement as is known in the art.

The installation kit 2 includes a first part 22, a second part 24, a connecting rod 26 extending between the first and second parts 22, 24, and a third part 28 which forms a threaded connection with the interconnecting rod 26. The first part 22 has a contact surface 30 which contacts the sink flange 6 to apply a compressive force to the sink flange 6 as described below. The contact surface 30 may have a conical or beveled shape to firmly engage the sink flange 6.

Figure 4:
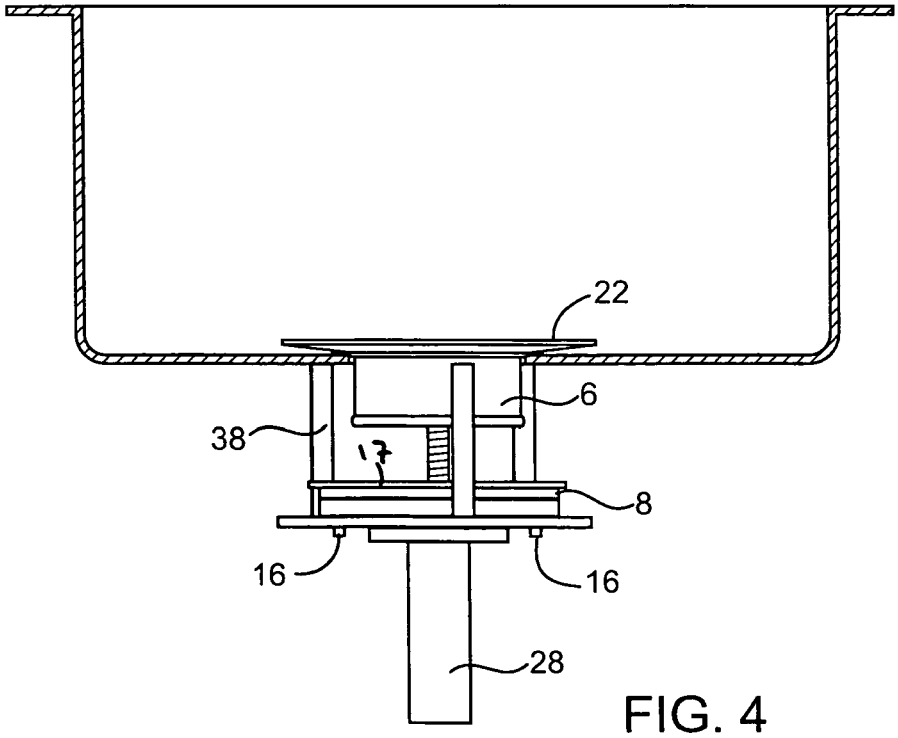
FIG. 4 shows the first and second parts moved toward one another to apply a holding force to the sink flange.

The second part 24 has a hole 32 through which the connecting rod 26 extends. The third part 28 has a threaded recess 34 which receives the connecting rod 26 so that rotation of the third part 28 moves the first and second parts 22, 24 toward and away from one another as required. The second part 24 may also have a plurality of holes 36 which receive the threaded elements 16 of the plumbing element 8. The second part 24 also has a plurality of stand-off arms 38. The stand-off arms 38 contact the underside of the sink as shown in FIG. 4 so that a compressive force is applied to the sink flange 6 when the first and second parts 22, 24 are moved toward one another as described below.

Use of the installation kit 2 is now described. The first part 22 is positioned in contact with the sink flange 6 with the connecting rod 26 extending down the sink drain. The plumbing element 8, such as the strainer assembly 11, is positioned on the second part 24 with the threaded elements 16 positioned in the holes 36 in the second element 24. The second part 24 is then coupled to the first part 22 using the threaded connection between the first and third parts 22, 28. The third part 28 is then rotated to move the first and second parts 22, 24 together until the stand-off arms 38 contact a surface beneath the sink and the desired compressive force is applied to the sink flange 6.

Figure 5:
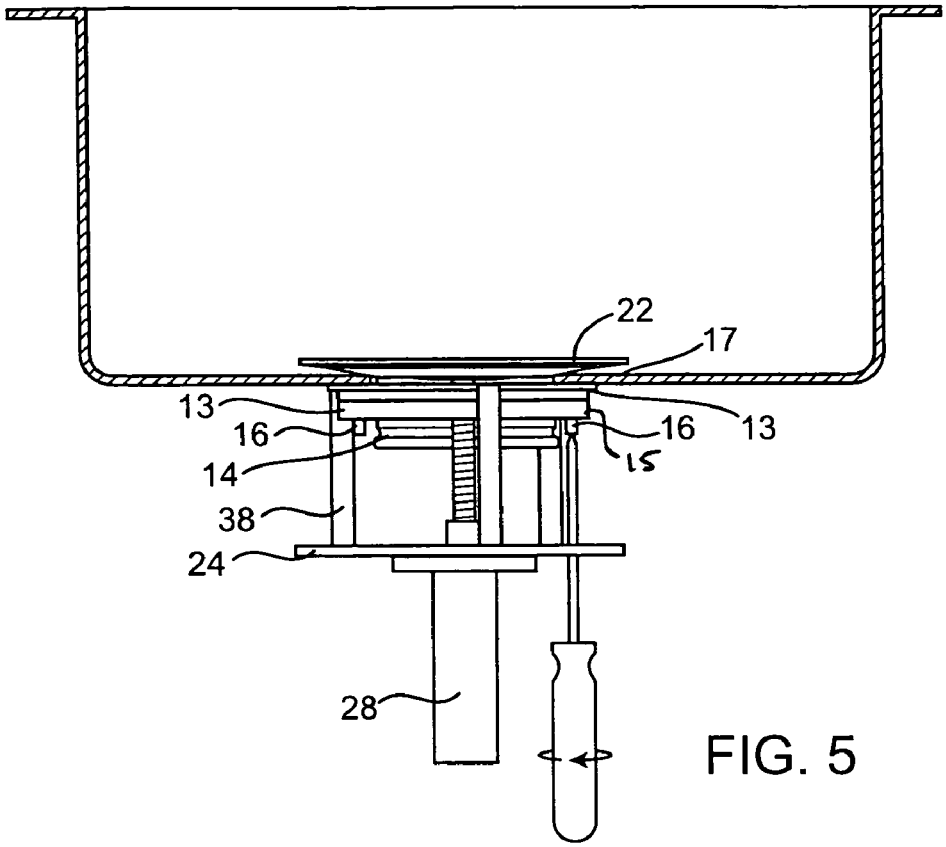
FIG. 5 shows the threaded elements of the plumbing element mounted on the sink flange.
Figure 6:
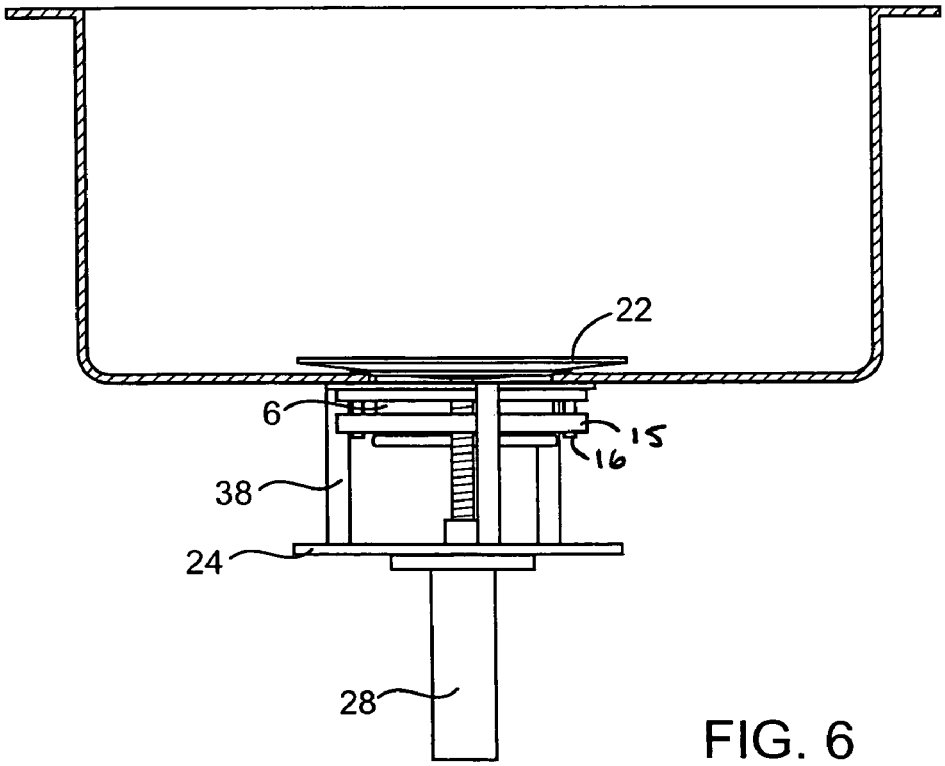
FIG. 6 shows the plumbing element secured to the sink flange.
Figure 7:
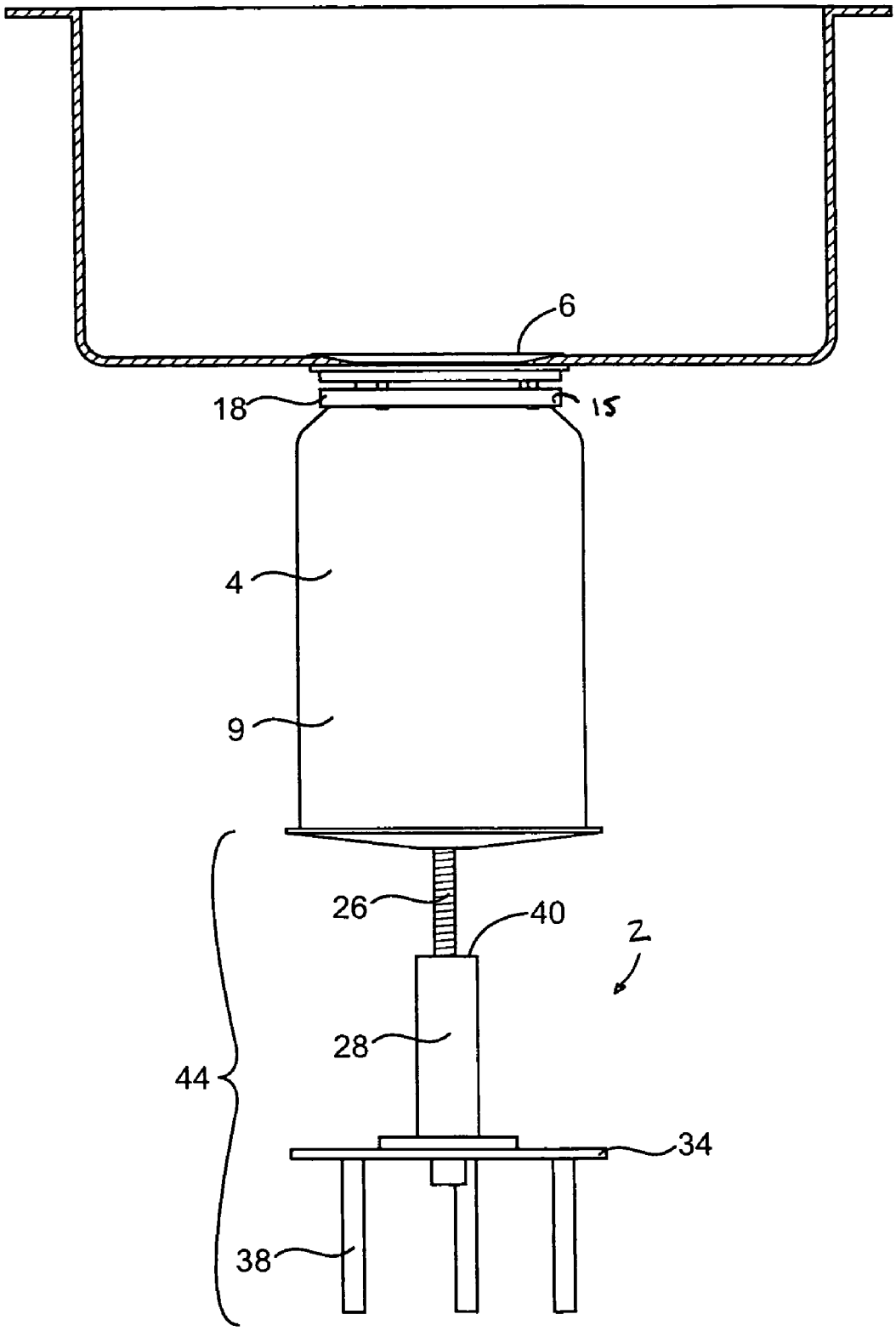
FIG. 7 shows the installation kit configured as a stand to support the disposer motor assembly.

While the compressive force is applied to the sink flange 6, the plumbing element 8 is then attached to the sink flange 6. A screwdriver is introduced into the holes 36 so that the screwdriver may be used to manipulate the threaded elements 16 as shown in FIG. 5 to attach the plumbing element 8 to the sink flange 6. Manipulation of the threaded elements 16 causes the upper and lower parts 13, 15 to spread apart from one another so that the snap ring 14 engages the groove 9 in the sink flange and the cardboard disk 17 is compressed against the underside of the sink.

The installation kit 2 may also be used to support the motor assembly 9 when attaching it to the plumbing element 8 or any other part of the sink or disposer 4. The third part 28 is decoupled from the connecting rod 26 and the second part 24 is turned over so that the stand-off arms 38 form legs for a stand 44 to hold the motor assembly 9. The connecting rod 26 is then engaged with the threaded recess 34 in the third part 28.

The motor assembly 9 is positioned on top of the first part 22 and may be raised and lowered as necessary by rotating the third part 28. The motor assembly 9 may be raised and lowered without rotating the motor assembly 9 so that the orientation of the motor assembly 9 may be fixed. Raising and lowering the motor assembly 9 without rotation also helps prevent the electrical cords and connectors from becoming tangled and also permits the user to select the desired orientation of the motor assembly 9 without changing the height of the stand. The first part 22 also has a cut-out portion 42 through which electrical connections and the like may extend.

The present invention may be sold as a stand-alone kit or may be sold with a garbage disposer. Furthermore, garbage disposer may take many forms and, in particular, the plumbing element 8 and manner in which the plumbing element 8 is attached to the sink, such as the sink flange, and also the manner in which the motor assembly is attached to the plumbing element 8 or any other part of the sink or disposer 4.

The invention claimed is:

1. A method of installing a garbage disposer in a sink, comprising the steps of:

providing a garbage disposer and an installation kit, the garbage disposer having a plumbing element and a motor unit, and the installation kit having a first part and a second part;

placing the first part of the installation kit in a sink with the first part contacting a sink flange;

supporting the plumbing element with the second part of the installation kit;

positioning the second part and the plumbing element beneath the sink;

coupling the first and second parts together with a connector extending through the sink drain between the first and second parts, the connector coupling the first and second parts together when the first part is in contact with the sink flange while the second part supports the plumbing element beneath the sink;

decoupling the first and second parts;

forming a stand with the first and second parts;

supporting the motor unit with the stand;

mounting the motor unit to the sink while the motor unit is supported by the stand; and attaching the plumbing element to the sink.

2. The method of claim 1, wherein:

the supporting step is carried out with the second part having a portion which interlocks with a part of the plumbing element to preserve the relative orientations of the second part and the plumbing element.

3. The method of claim 2, wherein:

the supporting step is carried out with the second part having a plurality of holes which each receive a threaded element on the plumbing element.

4. The method of claim 3, wherein:

the attaching step is carried out by rotating the threaded elements.

5. The method of claim 1, wherein:

the providing step is carried out with the plumbing element being a strainer assembly.

6. The method of claim 1, further comprising the step of:

applying a compressive force to the sink flange with the first part.

7. The method of claim 6, wherein:

the applying step is carried out during the attaching step.

8. The method of claim 7, wherein:

the applying step is carried out by changing the distance between the first and second parts after the coupling step.

9. The method of claim 8, wherein:

the applying step is carried out by manipulating a threaded connection to reduce the distance between the first and second parts.

10. The method of claim 9, wherein:

the applying step is carried out with a third part, the third part having the threaded connection with the first part, the applying step being carried out by rotating the third part.

11. The method of claim 1, wherein:

the attaching step is carried out with the sink connector being attached to the sink flange.

12. The method of claim 11, wherein:

the providing step is carried out with the plumbing element having a snap fit connection with the sink flange.

13. The method of claim 1, wherein:

the supporting step being carried out with the stand being vertically movable.

14. The method of claim 1, wherein:

the supporting step is carried out with the stand being vertically movable without rotating the motor unit.

* * * * *